United States Patent [19]

Granberg et al.

[11] Patent Number: 4,898,124

[45] Date of Patent: Feb. 6, 1990

[54] SCALE AGITATOR

[75] Inventors: Dirk N. Granberg, Fenton, Mich.; Frank H. Suchomel; Robert W. Ryno, both of El Paso, Tex.

[73] Assignee: A. O. Smith Corporation, Milwaukee, Wis.

[21] Appl. No.: 296,187

[22] Filed: Jan. 11, 1989

[51] Int. Cl.[4] ..... F22B 37/54; F22B 37/18; F22B 37/52

[52] U.S. Cl. ..... 122/382; 122/380; 122/381; 122/392; 122/405

[58] Field of Search ..... 122/380, 381, 382, 392, 122/405, 407, 361, 360, 13 R, 384

[56] References Cited

U.S. PATENT DOCUMENTS

| | | | |
|---|---|---|---|
| Re. 32,517 | 10/1987 | Nelson | 122/379 |
| 1,971,020 | 8/1934 | Snow | 122/392 |
| 2,140,744 | 12/1938 | Hirsch | 62/7 |
| 2,290,368 | 7/1942 | Dutton | 122/405 |
| 2,297,808 | 10/1942 | Soucy . | |
| 2,427,422 | 9/1947 | Sebald . | |
| 2,657,804 | 11/1953 | Epstein | 210/152 |
| 3,108,608 | 10/1963 | Mahowald | 134/198 |
| 3,503,554 | 3/1970 | Clifton | 239/23 |
| 3,623,668 | 11/1971 | Freid et al. | 239/265.17 |
| 3,915,122 | 10/1975 | Schröder | 122/381 |
| 4,157,077 | 1/1979 | Lindahl | 122/159 |
| 4,257,355 | 3/1981 | Cook | 122/17 |
| 4,263,879 | 4/1981 | Lindahl | 122/159 |
| 4,443,551 | 4/1984 | Lionetti et al. | 502/41 |
| 4,572,284 | 2/1986 | Kätscher et al. | 122/392 |
| 4,610,851 | 9/1986 | Colvert et al. | 422/310 |
| 4,700,662 | 10/1987 | Fasnacht, Jr. et al. | 122/382 |
| 4,715,324 | 12/1987 | Muller et al. | 122/382 |
| 4,838,211 | 6/1989 | Vago | 122/382 |

FOREIGN PATENT DOCUMENTS

| | | | |
|---|---|---|---|
| 3915 | of 1888 | United Kingdom | 122/381 |

*Primary Examiner*—Edward G. Favors
*Assistant Examiner*—Denise L. Ferensic
*Attorney, Agent, or Firm*—Christie, Parker & Hale

[57] ABSTRACT

A scale agitator for tank type liquid heaters employs a flexible non-cathodic tube through which liquid can flow. The liquid can be obtained from the tank or the supply of makeup liquid to be heated can be used. The tube may be fastened to a clean-out cover mounted to the exterior of the tank so that the tube can be inserted into and removed from the tank through the opening behind the clean-out cover.

17 Claims, 1 Drawing Sheet

SCALE AGITATOR

FIELD OF THE INVENTION

This invention pertains to the field of inlet tubes for fluid heaters and, more particularly, to a removable scale agitator for a water heater.

BACKGROUND OF THE INVENTION

Conventional tank heaters and, particularly, water heaters are subject to the accumulation of sediment at the bottom of the tank. In tank type water heaters, particles in the water settle out during heating and accumulate at the bottom to form a constantly expanding layer of scale. The scale promotes corrosion of the tank, inhibits heat conduction from the tank bottom to the water, and interferes with the fluid passageways. Eventually, the scale causes a premature breakdown of the tank heater.

To combat this problem, scale agitators have been developed. See, e.g., U.S. Pat. No. 4,263,879 to Lindahl and U.S. Pat. No. 4,257,355 to Cook. Typically, the scale agitators use a perforated tube within the tank. The incoming cold water supply to the heater tank is routed through the tube and sprayed out the perforations in different directions around the bottom of the tank to stir up the particles which have accumulated there. Forced into suspension in the water again, some of the particles are carried out the hot water outlet near the top of the tank when the hot water is used.

However, the scale agitator tubing is subject to the same scale particles as the tank. The perforations in the tube are easily clogged because they are so small. When the perforations are clogged, not only are particles allowed to accumulate on the bottom of the tank, but cold makeup water can no longer enter the tank. When this happens, the tube must be cleaned. Thorough cleaning requires that the tube be removed. Yet, in some designs, the tube is made of curved metal specifically adapted for the particular tank and cannot be removed. The entire tank must therefore be replaced. In addition, the metal tube places a cathodic load on the heater's anode protection system which increases the rate of anode consumption. Thus, in some instances, the presence of this type of scale agitator can actually shorten the lifetime of the heater.

SUMMARY OF THE INVENTION

The present invention overcomes these shortcomings in the prior art by providing a flexible scale agitator tube, which can be easily removed and installed through the clean-out cover which is commonly placed near the bottom of water heaters. In addition, when constructed of plastic materials, the present invention reduces corrosion because it does not create any additional cathodic demands on the anodic protection system.

An inlet liquid distributor for a scale agitator is provided for a tank type liquid heater. The heater has a cleanout opening cover near the bottom of the tank with a fitting. One side of the fitting is coupled to incoming tank liquid and the other side of the fitting is coupled to the tank's interior. The liquid distributor has a flexible elongated tube (e.g. polypropylene) which is sealed at one end and can be mounted to the fitting on the other end, so that it can be inserted into and withdrawn from the tank through the cleanout opening and held in place by the fitting. The tube is designed so that the tank's interior wall forces the tube to flex into an arc when the tube is inserted into the tank. The tube also has an array of openings along its length, which spray liquid in different directions across the bottom of the tank.

DETAILED DESCRIPTION OF THE INVENTION

Figure 1:
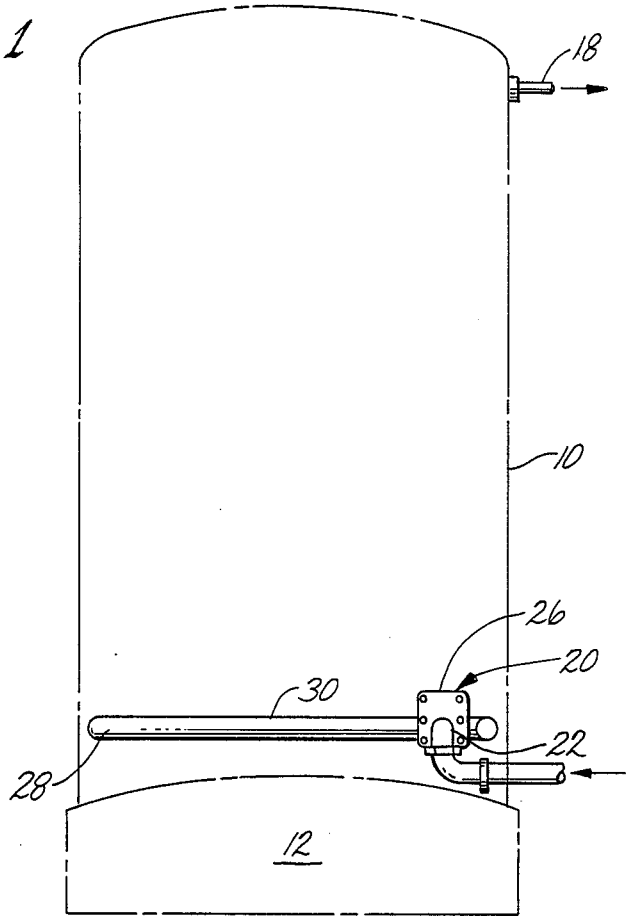
FIG. 1 is a side elevational view of a water heater incorporating the present invention.

FIG. 1 shows a typical tank type heater suitable for use with the present invention. The heater in this case is a conventional gas water heater. However, it should be understood that the present invention is equally well suited to heaters using different heat sources. The present invention is also equally well suited to heaters for other liquids besides water in which an agitator is desired.

In FIG. 1, the heater has a vertical cylindrical water tank 10. While the tank may be in any other shape, for example, ellipsoidal or block shaped, cylindrical tanks are generally preferred for a variety of reasons. Below the tank is a burner section 12. Near the top of the tank, there is a hot water outlet 18, and near the bottom of the tank, there is a water inlet 20.

Figure 2:
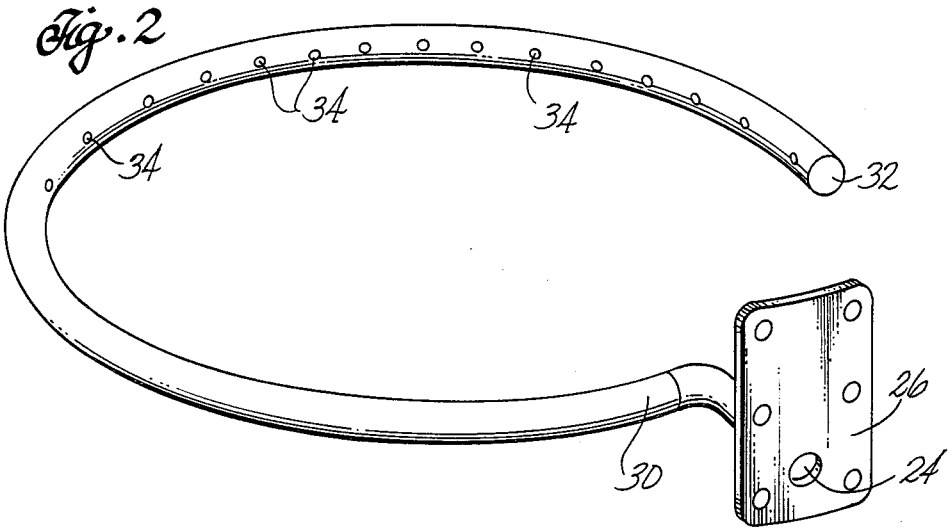
FIG. 2 is a perspective view of the present invention with some related components.

The water inlet 20 has an inlet pipe 22 which connects to a fitting 24 (shown in FIG. 2). The fitting is mounted to a clean-out cover 26 which is bolted to the exterior wall of the tank 10. The clean-out cover is bolted over an opening (not shown) near the bottom of the tank which is used for cleaning the tank. The cover seals the opening and prevents leaks. Inside the tank, the fitting 24 connects to the scale agitator 28 of the present invention. The scale agitator includes a tube 30. The tube circles around the bottom of the tank near the interior walls of the tank carrying incoming water.

FIG. 2 shows the scale agitator 28 and some associated components in greater detail. The clean-out cover 26 carries the fitting 24 and the fluid inlet pipe 22. As shown in FIG. 2, the fitting is a welded fitting; however, the fitting may use threads or any other type of fastening well known in the art. The opposite side of the fitting carries a tube 30. The tube may be fastened to the fitting using any of the variety of techniques well known in the art. The tube is preferably made of flexible polypropylene and has a slight bend to it. Other materials and even non-plastic materials may be used, provided that the tube is flexible.

It is preferred that the chosen material not be a cathode with respect to the usually steel tank. At least in water tanks, corrosion is enhanced by the ionic activity of the particles in the liquid. Heaters are normally designed to avoid cathode loading, so it is important that the tube be designed to avoid cathode loading as well. Plastics like polypropylene are well suited for the tube because they do not affect the cathodic characteristics of the heater.

It is not necessary that the tube have a slight bend to it, but the intrinsic curvature of the tube eases installation.

The tube has a plug 32 at the opposite end of the fitting 24 but includes a row of small openings 34 along its entire length which allow the inlet liquid, in this case incoming water, to enter the tank. The openings are arranged so that when the tube is installed in the tank, water is sprayed from the outer edge of the tank towards the middle of the tank. This spraying action agitates the scale which has settled onto the bottom of the tank.

The agitation can be enhanced by adjusting the size, shape and location of the holes. Flow through the openings can also be enhanced using similar techniques. It is presently preferred that the size of the openings be adjusted so that, when added together, their cross sectional area exceeds the interior cross sectional area of the fitting. The interior of the fitting is the passage through which all liquid entering the tube must pass.

The openings 34 in the tube may also be fitted with a variety of nozzles and extensions or directed in different directions as is well known in the art to further enhance their effect.

In operation, the tube, together with some device for mounting it to the fitting, forms an easily removed distributor for the inlet liquid. When the openings in the tube become clogged or constricted by scale or some other particles, the inlet pipe 22 is removed from the clean-out cover 26, then the clean-out cover is removed from the exterior wall of the tank. The tube can then be pulled out of the tank through the opening behind the clean-out cover. The tube can either be cleaned or replaced and then reinserted into the tank through the opening behind the clean-out cover. Once the tube is inserted into the tank, the clean-out cover is reattached to the tank. Thus, replacement of the entire heater is not necessary when the scale agitator becomes clogged.

Since the tube is flexible, when the tube is pushed into the tank it will be urged into an arc by the interior wall of the tank as shown in FIG. 2. If the tank is not cylindrical, the tube will still be forced into some type of curve. However, the curve may not then be an arc. If the tube is approximately the same length as the circumference of the tank then it will arc around most of the inner circumference of the tank. However, since the tube is flexible it can be used in tanks of different shapes and in tanks which have different radii of curvature. The metal tubes commonly used at present are fabricated to match the shape of the tank.

Alternatively, the device shown in FIG. 2, including the tube fitting and the clean-out cover, could be supplied as a single unit. The clean-out cover would be removed and replaced along with the tube in that case. The invention may also be adapted for heaters in which the scale agitation system is separate from the cold liquid supply line. For example, water could be pumped from the tank to the scale agitator so that the cold liquid supply is not interrupted when the agitator is clogged. In that case, the inlet pipe 22 would connect to a pump and not to the cold liquid supply line.

While the present description has been limited to a single embodiment of the invention, it should be well understood that many modifications and adaptations of this embodiment as well as other embodiments are possible without departing from the spirit and scope of the present invention. By describing only one embodiment herein, the applicant does not intend to abandon these other embodiments, adaptations and modifications.

What is claimed is:

1. In a liquid heater having a tank in which the liquid is heated, a liquid inlet near the base of the tank, and a fitting at the liquid inlet, one side of which is in communication with incoming liquid, and the other side of which is in communication with the tank's interior, an inlet liquid distributor comprising:

a flexible elongated tube, one end of which is plugged and the other end of which is adapted to be mounted to the liquid inlet fitting so that the tube can be inserted into and withdrawn from the tank through the liquid inlet and held in place by the fitting, the tube being longer than the diameter of the tank so that the tank's interior wall forces the tube to flex into a curve when the tube is inserted into the tank; and a plurality of openings along the tube arranged for distributing the inlet liquid so that the inlet liquid is distributed in different directions by the different openings.

2. The distributor of claim 1 wherein the openings collectively are larger in cross sectional area than the passage through which the liquid inlet enters the tank.

3. The distributor of claim 1 wherein the tank has a substantially round base and the tube, when inserted into the tank, is flexed substantially into a partial ring along the inner circumference of the tank wall.

4. The distributor of claim 1 wherein the incoming liquid is obtained from the tank and then pumped through the fitting into the distributor.

5. The distributor of claim 1 wherein the incoming liquid constitutes the makeup liquid to be heated.

6. The distributor of claim 1 wherein the tube is made of anodic material.

7. The distributor of claim 1 wherein the tube is made of plastic.

8. The distributor of claim 7 wherein the plastic is polypropylene.

9. The distributor of claim 1 wherein the liquid is water.

10. In a liquid heater having a tank in which the liquid is heated, and an opening near the base of the tank, a liquid distributor comprising:

a cover adapted to close over and seal the opening;

a flexible elongated tube, one end of which is plugged and the other end of which is connected to the cover so that the tube can be inserted into and withdrawn from the tank through the opening and held in place by the cover, the cover having a fitting permitting access to the interior of the tube from outside the tank, and the tube being longer than the diameter of the tank so that the tank's interior wall forces the tube to flex when the tube is inserted into the tank; and a plurality of openings along the tube arranged so that liquid coming into the tank through the tube will be distributed in different directions by the openings.

11. The distributor of claim 10 wherein the cross sectional areas of the openings collectively are larger than the inside cross sectional area of the fitting.

12. The distributor of claim 10 wherein the tube is made of anodic material.

13. The distributor of claim 10 wherein the tube is made of plastic.

14. The distributor of claim 13 wherein the plastic is polypropylene.

15. The distributor of claim 10 wherein the liquid is water.

16. The distributor of claim 10 wherein the incoming liquid is obtained from the tank and then pumped through the fitting into the distributor.

17. The distributor of claim 10 wherein the incoming liquid constitutes the makeup liquid to be heated.

* * * * *